US005803313A

United States Patent [19]

Flatt et al.

[11] Patent Number: 5,803,313

[45] Date of Patent: Sep. 8, 1998

[54] HAND HELD FLUID DISPENSING APPARATUS

[75] Inventors: Larry W. Flatt; Chris M. Jamison, both of Hendersonville, Tenn.

[73] Assignee: Illinois Tool Works Inc., Glenview, Ill.

[21] Appl. No.: 651,681

[22] Filed: May 21, 1996

[51] Int. Cl.[6] ..... B05B 7/02

[52] U.S. Cl. ..... 222/146.5; 239/526; 251/321; 285/261

[58] Field of Search ..... 222/146.2, 146.5; 239/526, 525, 132–135; 285/121.7, 261; 251/321–323, 335, 319, 320

[56] References Cited

U.S. PATENT DOCUMENTS

| | | | |
|---|---|---|---|
| D. 245,474 | 8/1977 | Scholl . | |
| D. 279,074 | 6/1985 | Honeyman et al. . | |
| 2,724,615 | 11/1955 | Ariotti | 239/526 X |
| 3,443,058 | 5/1969 | Spencer . | |
| 3,507,309 | 4/1970 | Johnson | 239/526 X |
| 3,771,492 | 11/1973 | Lockwood . | |
| 3,888,421 | 6/1975 | Chow | 239/526 X |
| 3,913,844 | 10/1975 | Petrovic | 239/526 |
| 3,960,296 | 6/1976 | Nord . | |
| 3,973,697 | 8/1976 | Crum et al. . | |
| 4,006,845 | 2/1977 | Scholl et al. . | |
| 4,026,440 | 5/1977 | Crum et al. . | |
| 4,144,913 | 3/1979 | Akers et al. . | |
| 4,245,759 | 1/1981 | Baker et al. . | |
| 4,303,108 | 12/1981 | Akers et al. . | |
| 5,236,129 | 8/1993 | Grime et al. . | |
| 5,330,108 | 7/1994 | Grime et al. . | |
| 5,332,156 | 7/1994 | Wheeler . | |
| 5,332,159 | 7/1994 | Grime et al. . | |
| 5,507,534 | 4/1996 | Reifenberger et al. . | |

OTHER PUBLICATIONS

ITW Devilbiss Industrial Spray Equipment Brochure, OMX™ Spray Gun, 1995, 1 pg.

ITW Dynatec, Operations & Service Manual, PN 08C136 Spray Handgun, rev. Sep. 1994/1995, 11 pgs.

ITW Dynatec, Operations & Service Manual, PN 08C083 Handgun, rev. Sep. 1995, 6 pgs.

ITW Dynatec, Operations & Service Manual, CTS–90 Handgun, PN 084C192, rev. Aug. 1994, 36 pgs.

ITW Dynatec, Service Manual, DynaGun™ & Dynaswirl™, Nov. 1993, 17 pgs.

*Primary Examiner*—Kevin P. Shaver
*Attorney, Agent, or Firm*—Donald J. Breh

[57] ABSTRACT

A hand held apparatus for dispensing fluid from a fluid supply. The apparatus includes a housing with a first body portion and a second body portion, a conduit assembly coupled to the fluid supply, and a substantially balanced valve assembly interconnecting the conduit assembly and a nozzle. The valve assembly is actuatable by first and second independent triggers disposed on same side of the housing and protectable by a common trigger guard. The first trigger is usable to actuate the valve assembly when the first body portion of the housing is used as a hand grip, and the second trigger is usable to actuate the valve assembly when the second body portion of the housing is used as a hand grip. A connector assembly couples the fluid supply conduit to the conduit assembly. The connector assembly includes a conduit connector with a ball portion disposed in a ball socket having a sealing member disposed about a circumference of the ball portion. The sealing member is also disposed between a ball seat and a ball retainer wherein the conduit connector is rotatable and pivotable relative to the ball socket to improve orientability of the dispenser and to reduce operator fatigue.

20 Claims, 3 Drawing Sheets

130
40
105
103

700
600
500
140

S
B
T
500
540
c
c
700
730
364
366
362
H
110
102
104
40
126
412
422
120
850
361
360
324
B
820
800
100
200
300
126
850
850
132
130
40
134
430
432
442
400
410
433
136
b
b

HAND HELD FLUID DISPENSING APPARATUS

BACKGROUND OF THE INVENTION

The invention relates generally to a band held fluid dispensing apparatus, and more particularly to a hand held melted adhesive dispensing gun with a trigger actuatable valve assembly that controls fluid flow from a fluid supply to a fluid dispensing nozzle on the gun.

Hand held fluid dispensers of the type including a housing with a handle portion and barrel portion having a fluid dispensing nozzle directed away from the handle portion have many commercial and industrial applications. These dispensers are generally coupled to a fluid supply by a flexible fluid conduit that provides fluid to the hand held dispenser. The flexible fluid conduit, however, often interferes significantly with the operators ability to orient and operate the dispenser resulting in physical fatigue, which adversely effects productivity and is a suspected source of Carpel Tunnel Syndrome and other debilitating maladies. It has been suggested to couple the supply hose to the dispenser at a location away from the nozzle and toward the handle portion, which reduces any torque on the dispenser from the supply conduit and improves the operator's ability to orient the direction of the nozzle. Others have suggested rotatably coupling the supply hose to the dispenser to prevent twisting of the supply conduit and to improve the operator's ability to orient the dispenser about the axis of the supply conduit. Despite these advances, the operators ability to orient prior art hand held fluid dispensers continues to be impaired by the fluid supply conduit and by any electrical cables coupled to the dispenser, which result in operator fatigue and reduced productivity.

U.S. Pat. No. 5,332,159 to Grime et al. discloses an improved dual mode trigger for reducing operator fatigue on a typical hand held fluid dispenser having a barrel portion with a nozzle extending away from a handle portion. The improved trigger includes a primary trigger mounted adjacent the handle for use during conventional operation wherein the nozzle is directed at a substantially vertical surface, and a second trigger mounted on a top side of the barrel for alternative operation wherein the barrel is grasped as a handle and the nozzle is directed more readily up or down at a substantially horizontal surface. This dispenser, however, has the disadvantage that the second trigger protrudes from the top side of the dispenser barrel portion where it is exposed and subject to interference with supply hoses and cables. The protruding second trigger is also subject to inadvertent actuation, which may result in damage to property or personal injury.

The actuation of the trigger assembly on hand held dispensers is another source of operator fatigue. To dispense fluid from the nozzle, the trigger assembly must usually compress a spring member that biases a valve seating member into a valve seat to close the nozzle when the trigger is not actuated. The trigger assembly is typically leveraged to reduce the trigger pull required to compress the spring, but the dimensions and configuration of the dispenser housing often limit the extent to which the trigger pull can be reduced. Therefore, any reduction in the trigger pull required to actuate the valve assembly will reduce fatigue and increase operator productivity.

Some hand held fluid dispensers dispense heated fluids including melted adhesives supplied by a heated fluid supply conduit. These dispensers often include heated components within the housing, and may include temperature regulation control means, to maintain fluid viscosity, which is required for accurate dispensing of the fluid through the nozzle. The heated components, however, must be insulated to permit handling of the dispenser. Insulation is particularly important in applications where the portion of the housing containing the heated components is used as a hand grip by the operator. Existing insulation materials, however, sometimes require increased housing dimensions to accommodate the insulation material necessary to insulate adequately the heated components. The operator of hand held heated fluid dispensers is, moreover, also exposed to hot components external of the dispenser including the heated fluid supply conduit and the nozzle, which may potentially cause serious personal injury. Other applications utilize heated air supplied to the nozzle by an auxiliary air supply hose wherein the heated air modifies the flow of fluid dispensed by the nozzle. The auxiliary air supply hose, however, also becomes hot and is therefore another source of occupational hazard. There is therefore a need for providing a fluid dispenser which reduces the operators exposure to heated components and supply conduits internal and external to the dispenser.

In view of the discussion above, there exists a demonstrated need for an advancement in the art of a hand held fluid dispensing apparatus.

It is therefore an object of the invention to provide a novel hand held fluid dispensing apparatus that overcomes the problems in the prior art.

It is also an object of the invention to provide a novel band held fluid dispensing apparatus that is economical and reliable.

It is another object of the invention to provide a novel hand held fluid dispensing apparatus having a trigger assembly with independent first and second triggers, which facilitate operation of the dispenser in different orientations, wherein the trigger assembly is protectable by a single trigger guard.

It is yet another object of the invention to provide a novel hand held fluid dispensing apparatus with a connector assembly that permits improved orientation of the dispensing apparatus and reduces interference from a fluid supply conduit.

It is a further object of the invention to provide a novel hand held fluid dispensing apparatus with a substantially balanced valve assembly, which reduces the trigger pull required to dispense fluid from the nozzle.

It is a still further object of the invention to provide a novel hand held fluid dispensing apparatus comprised of modular sub-assemblies.

It is yet another object of the invention to provide a novel hand held fluid dispensing apparatus usable to dispense heated fluids wherein the dispenser insulates the operator from heated components internal and external to the dispenser.

Accordingly, the present invention is drawn to a novel hand held apparatus for dispensing fluid supplied by a fluid supply conduit from a fluid supply. The apparatus includes a housing with a first body portion and a second body portion, a conduit assembly coupled to the fluid supply, and valve assembly interconnecting the conduit assembly and a fluid dispensing nozzle. The valve assembly includes a valve stem with a valve seating member biased toward a valve seat by a spring member to close the nozzle. A spring force required to seat the valve seating member on the valve seat is reduced in proportion to the extent that the valve assembly is balanced. The valve assembly is actuatable by a first trigger disposed on one side of the housing, or by an independent second trigger disposed on the same side of the housing as the first trigger. The first trigger is usable to actuate the valve assembly when the first body portion of the housing is used as a hand grip, and the second trigger is usable to actuate the valve assembly when the second body portion of the housing is used as a hand grip. A common trigger guard interconnects the first body portion and the second body portion to enclose and protect the first and second triggers. A connector assembly couples the fluid supply conduit to the conduit assembly, and is ergonomically located on the dispenser to improve orientability of the dispenser and to reduce operator fatigue. The connector assembly includes a conduit connector with a ball portion disposed in a ball socket having an annular sealing member disposed about a circumference of the ball portion. The sealing member is also disposed between a ball seat and a ball retainer wherein the conduit connector is rotatable and pivotable relative to the ball socket to further increase orientability of the dispenser and to further reduce operator fatigue. In applications where the hand held fluid dispenser dispenses a heated fluid, a thermal insulation material within the housing insulates the operator from any heated components disposed within the housing, and the location of the connector assembly reduces operator exposure to the heated supply conduit.

These and other objects, features and advantages of the present invention will become more fully apparent upon consideration of the following Detailed Description of the Invention with the accompanying drawings, which may be disproportionate for ease of understanding, wherein like structure and steps are referenced by corresponding numerals and indicators.

DETAILED DESCRIPTION OF THE INVENTION

Figures 1A, 1B, 1C:
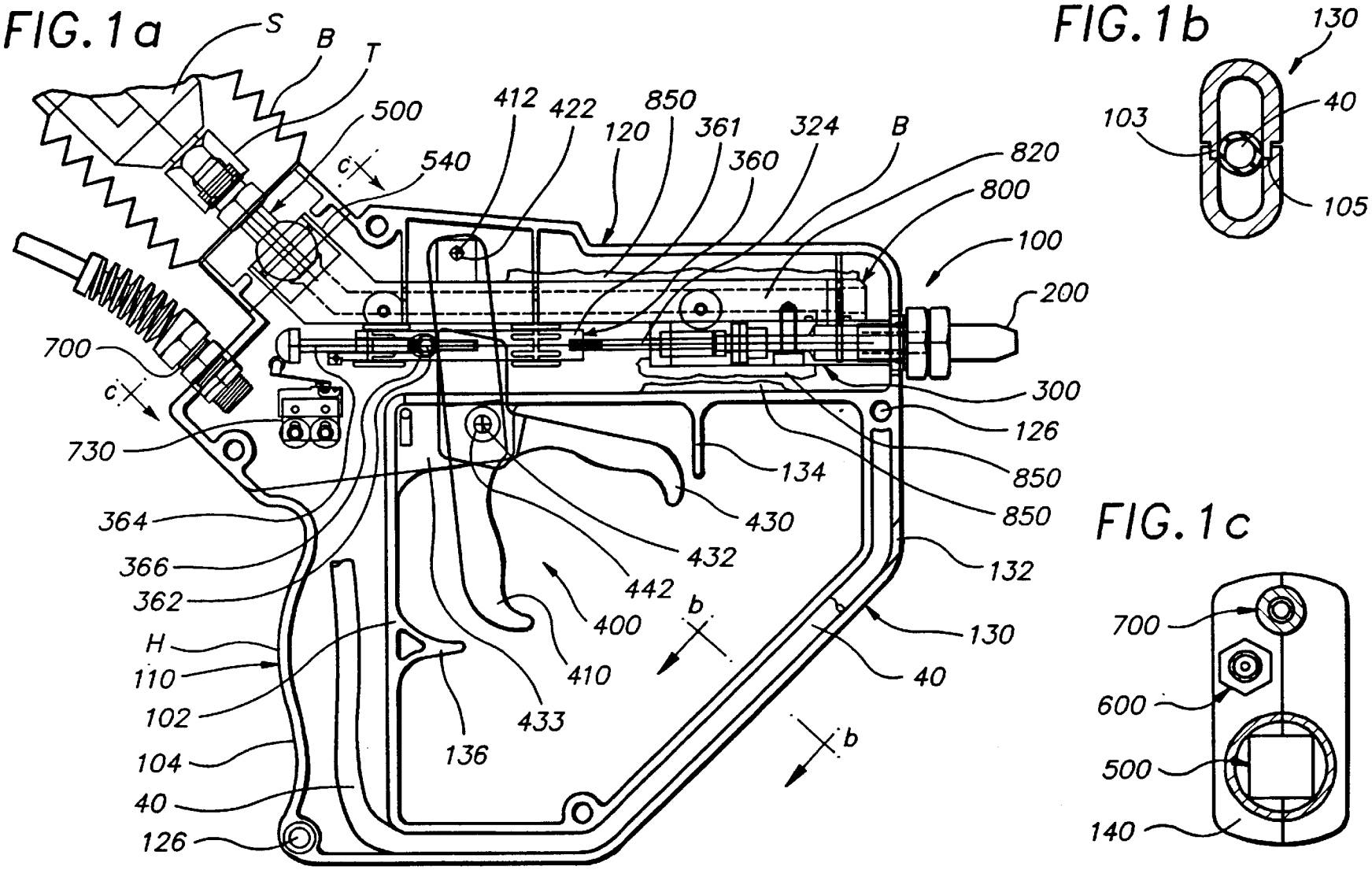
FIG. 1*a* is a partial sectional view of a hand held fluid dispensing apparatus according to an exemplary embodiment of the invention.
FIG. 1*b* is a sectional view along lines b—b of FIG. 1*a*.
FIG. 1*c* is a partial end view along lines c—c of FIG. 1*a*.

FIG. 1*a* is a hand held apparatus for dispensing fluid supplied through a fluid supply conduit S from a fluid supply, not shown in the drawing. The apparatus comprises generally a housing 100 with a nozzle 200 for dispensing fluid supplied from the fluid supply, a valve assembly 300 disposed in the housing and coupled between the nozzle 200 and the fluid supply, and a trigger assembly 400 for actuating the valve assembly 300 to control fluid dispensed by the nozzle 200. Although several embodiments of the invention are disclosed in the context of hand held melted adhesive applicators, the objects, features and advantages of the invention are also applicable to other types of hand held fluid dispensers including among others paint spray applicators, fuel dispensers and pneumatic tools.

The housing 100 includes a first body portion 110 and a second body portion 120 having at least one interior cavity for receiving the valve assembly 300 and other components within the housing. In one embodiment, the first body portion 110 is a handle H, and the second body portion 120 is a barrel B with a fluid dispensing end having the nozzle 200 extending away from the handle H. The handle H and the barrel B may have ergonomic contours to facilitate handling or gripping the dispenser housing in one of two alternative modes of operation as further discussed below. In the exemplary embodiment, the housing 100 includes a trigger guard 130 interconnecting the barrel B and the handle H wherein the trigger guard 130 encloses the trigger assembly 400 to protect and prevent inadvertent actuation of the trigger while providing ready access to the trigger assembly. The housing may alternatively include flanges 134 and 136 to prevent entry of foreign objects behind the triggers, which may obstruct or interfere with trigger operation.

In one embodiment, the housing 100 is comprised of two matable housing portions, which form a housing subassembly or module. Each housing portion includes an inner peripheral mating surface 102 and an outer peripheral mating surface 104 as shown on the handle portion of the housing in FIG. 1*a*. The housing portions are retained in mating relationship by threaded members disposed through a plurality of holes 126 through the mating housing portions. The mating housing portions may alternatively be retained by resilient snapping clips, or other known fastening means. FIG. 1*b* illustrates a protruding flange 103 on the mating surfaces 102 and 104 of one housing portion and a complementary recess 105 on the mating surfaces 102 and 104 of the mating housing portion. The complementary flange and recess configuration of the housing portions provides a strong, precise fitting housing assembly resistant to entry of fluid and particulate matter into the housing cavities. In one embodiment, the housing is molded from a strong, light weight synthetic resinous material, which is resistant to corrosion by the fluid dispensed from the nozzle. Other embodiments may be fabricated or cast from metallic materials, which may be required for use in other applications.

FIG. 1*c* is an end view of a connector mounting interface 140 of the housing 100 for receiving a fluid supply conduit connector 500, an alternative auxiliary air supply connector 600, and an alternative electrical system connector 700. The connector mounting interface 140 is positioned proximate the intersection of the handle H and barrel B and away from the nozzle 200 to minimize any interference and resulting fatigue caused by the electrical cables and supply conduits. The location of the connector mounting interface 140 facilitates the coupling of supply conduits and electrical cables suspended above the operator from a ceiling or other support means, which relieves the operator from having to support the full weight of the supply conduits and cables. The location of the connector mounting interface 140 is also substantially symmetrically located between the barrel B and the handle H to provide a more balanced hand held dispenser, which facilitates alternative modes of dispenser operation as discussed further below. In one embodiment, the connector mounting interface 140 is formed as an integral part of either one or both matable housing portions, which form the housing module.

Figure 5A:
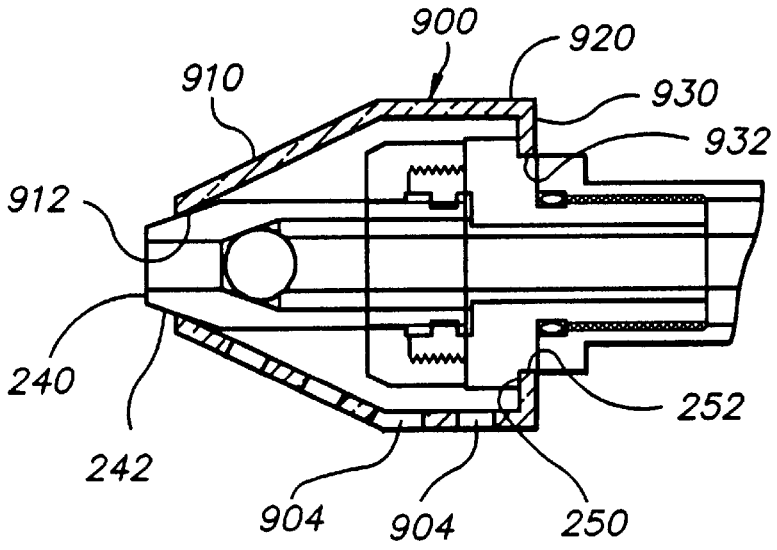
FIG. 5*a* is a partial sectional view of a fluid dispensing nozzle and thermal insulating boot according to an exemplary embodiment of the invention.
Figure 5B:
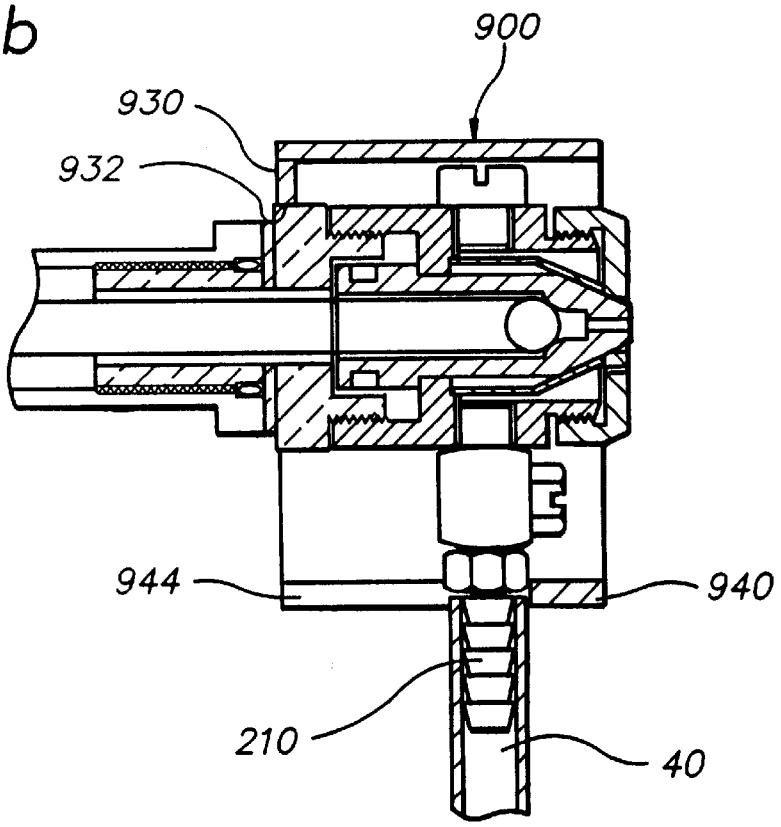
FIG. 5*b* is a partial sectional view of a fluid dispensing nozzle and thermal insulating boot according to an alternative embodiment of the invention.

In some applications, compressed hot air is used to modify the flow of fluid dispensed from a swirl nozzle of the type shown in FIG. 5*b*, which is adapted to mix the compressed air with the fluid. In one embodiment, the trigger guard 130 is a hollow member for plumbing a hot air supply hose 40 within the housing between the auxiliary air supply connector 600 at the mounting interface 140 and the nozzle 200 at the front portion of the apparatus as shown in FIG. 1*a*. An exterior hot air supply hose, not shown, may be coiled about a heated fluid supply conduit S, and coupled to the auxiliary air supply connector 600 on the interface 140. The hollow trigger guard 130 communicates with a housing cavity in the handle H and provides a path toward the nozzle end of the barrel B. In the exemplary embodiment, the hollow trigger guard includes a port hole 132 proximate the nozzle end of the barrel B through which the hose 40 is fed for coupling with a downwardly extending hose adaptor 210 on the swirl nozzle as shown in FIG. 5*b*. The hollow trigger guard 130 insulates the operator from the hot air supply hose 40, retains heat in hose 40, and prevents the hose 40 from dangling from the nozzle end of the barrel B where it may cause interference. A thermal insulating material may be disposed about the air hose 40 in the cavity portions of the housing to increase thermal insulation.

FIGS. 5*a* and 5*b* illustrate an insulating boot 900, which is alternatively disposed about the nozzle 200 for protecting the operator from contact with the nozzle 200, which may be heated. The insulating boot 900 also prevents the nozzle 200 from becoming obstructed or entangled in the work environment. FIG. 5*a* is a typical bead type nozzle 200 shielded by an insulating boot 900 having a tapered portion 910 disposed about a portion of the nozzle 200. The tapered portion 910 reduces any obstruction to visibility of the nozzle end 240, and in the exemplary embodiment the tapered portion 910 is slightly recessed from the nozzle end 240 to further increase visibility and to provide increased penetration of the nozzle 200 into work areas. The insulating boot 900 includes a coupling end portion 920 for coupling the boot 900 onto the nozzle 200. In the exemplary embodiment, the coupling end portion 920 includes a resilient annular flange 930 with a reduced diameter portion 932 that snap-fits over a lip 250 and seats on a seat 252 of the nozzle 200 for retaining the insulating boot 900 about the nozzle 200. In an alternative embodiment, the annular flange 920 includes a threaded inner surface engagable with a threaded outer surface of the nozzle 200, not shown in the drawing. In the exemplary embodiment, the tapered portion 910 of the insulating boot 900 includes an inner surface portion 912 that seats on an outer surface 242 of the nozzle 200 for increased mounting stability of the insulating boot 900 about the nozzle 200. In one embodiment, the insulating boot 900 includes a plurality of apertures 904 for venting heat accumulated in the area of the nozzle 200, as shown on a lower side of the insulating boot 900 in the exemplary embodiment. FIG. 5*b* is an insulating boot 900 with an alternative configuration that may be disposed about a swirl nozzle having a ribbed air hose adapter 210 coupled to the air hose 40, which provides hot air for modifying the flow of fluid through the nozzle as discussed above. The insulating boot 900 includes a lower portion 940 extending downward to envelope the air hose adapter 210 and a slot 944 in the lower portion 940 for positioning the boot 900 over the adapter 210. The insulating boot 900 may include a resilient annular flange portion 930 with a reduced diameter portion 932 that snap-fits over a portion of the nozzle 200 for retaining the insulating boot 900 about the nozzle 200. Additionally, the slot 944 may be sized to engage portions of the hose adapter 210 for retaining the insulating boot 900 about the nozzle 200. The insulating boot 900 is fabricated of an insulating material including TeflonTM, or Viton™, or a fiberglass cloth reinforced resin composition, and may be formed in a molding or other fabrication process.

The trigger assembly 400 is movable to actuate the valve assembly 300 coupled between the fluid supply and the nozzle assembly 200. In the exemplary embodiment, the trigger assembly 400 includes a first trigger 410 disposed on one side of the housing 100 and a second trigger 430 disposed on the same side of the housing as the first trigger 410. In this configuration, the first and second triggers are protectable by a common trigger guard 130, which reduces the size and complexity of the housing and provides a relatively reduced profile dispenser. The first trigger 410 is a primary trigger usable to actuate the valve assembly 300 when the first body portion 110 is used as a hand grip, and the second trigger 430 is a secondary trigger usable to actuate the valve assembly 300 when the second body portion 120 is used as a hand grip in an alternative mode of dispenser operation. The alternative triggers facilitate operation of the dispenser in either a vertical orientation or a horizontal orientation, which reduces operator fatigue. In the exemplary embodiment, the first trigger 410 is coupled pivotally relative to the housing about a pivot axis 412, which may be a pivot pin supported by the housing or by structure within the housing. In the exemplary embodiment, the pivot axis 412 extends through a body portion 800 mounted in the housing. The second trigger 430 is also coupled pivotally relative to the housing about a pivot axis 432, which may also be a pivot pin supported by the housing or by structure within the housing. In the exemplary embodiment, the pivot axis 432 extends through a flange 433 extending from opposing sides of the housing. The first trigger 410 includes a valve actuator engagement surface 416 for actuating the valve assembly 300 when the first trigger 410 is pivoted or moved toward the first body portion 110 as further discussed below. The second trigger 430 also includes a valve actuator engagement surface 436 for actuating the valve assembly 300 when the second trigger 430 is pivoted or moved toward the second body portion 120. In the preferred embodiment, the respective trigger pivot axes 412 and 432 are located to maximize leverage and minimize the force, or trigger pull, required to actuate the valve assembly 300, which further reduces operator fatigue.

Figure 2A:
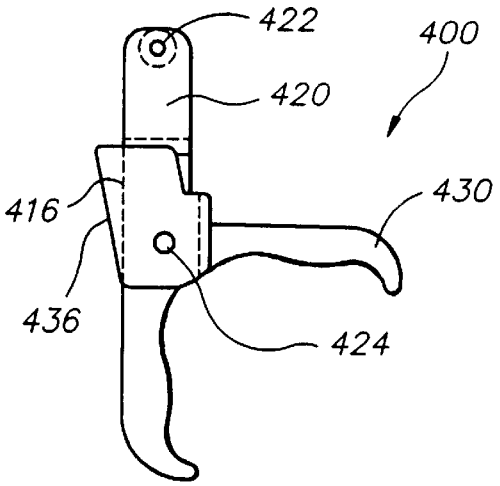
FIG. 2*a* is a partial side view of a nested trigger assembly according to an exemplary embodiment of the invention.
Figure 2B:
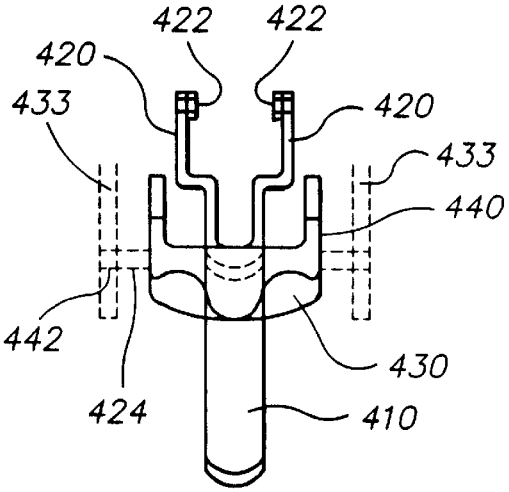
FIG. 2*b* is a partial front view of FIG. 2*a* including a partial phantom view of a hand held fluid dispenser housing.
Figure 3B:
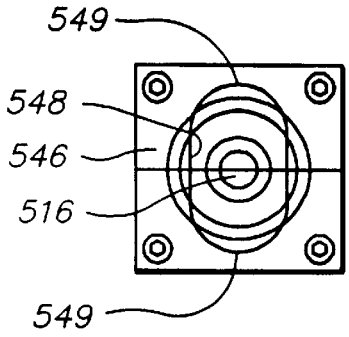
FIG. 3*b* is a partial top view of FIG. 3*a*.

In the exemplary embodiment of FIG. 2, the first trigger 410 is nested within the second trigger 430, but the second trigger may alternatively be nested within the first trigger. The first trigger 410 includes resilient flanges 420 with a corresponding mounting tab 422 pivotally supported by corresponding recesses in the body member 800 mounted within the housing wherein the first trigger 410 is pivotal about the axis 412 through the tabs 422. The second trigger 430 includes resilient flanges 440 with a corresponding protruding pin 424 pivotally supported by corresponding recesses 442 in the housing flange 433 wherein the second trigger 430 is pivotal about the axis 432 through the pins 424. The nested trigger assembly is readily mounted in the housing during assembly of the two mating housing portions discussed above. In an alternative embodiment, each pin 424 extends from a corresponding housing flange 433 and into a corresponding supporting aperture on the flange 440 of the second trigger 430. The first and second triggers are operable to actuate the valve assembly 300 independent of each other wherein pivoting the one trigger does not require or result in pivoting the other trigger. In an alternative embodiment, the first and second triggers are both independently coupled pivotally to the housing without nesting one trigger within the other. The first and second triggers preferably have ergonomic contours, to reduce operator fatigue, and are moldable from a plastic material. The triggers may alternatively be fabricated or cast from a metal material. The exemplary two piece, dual trigger assembly of FIG. 2 forms a trigger sub-assembly or module of the dispenser, which is relatively inexpensive, simple to assemble, easy and reliable to operate, and protectable by a single trigger guard.

FIG. 1*a* shows a supply conduit S for supplying fluid from the fluid supply, not shown in the drawing, to the fluid supply conduit connector assembly 500 mounted on the mounting interface 140 of the housing 100. The conduit connector assembly 500 is coupled generally to the nozzle 200 by a conduit assembly 800, which is interconnected to the nozzle 200 by the valve assembly 300. In the exemplary melted adhesive applicator embodiment, the conduit assembly 800 is a heated body member formed of a heat conducting material, like metal, with a fluid conduit 820 and one or more heating elements, not shown in the drawing. The conduit assembly 800 may alternatively include one or more temperature sensors to provide temperature data, through an electrical cable coupled to the housing by the electrical connector 700, to a temperature regulating controller means located outside the housing 100. In the exemplary embodiment, the conduit assembly 800 forms a conduit sub-assembly or module. The conduit assembly 800 is mountable in the housing 100 and readily connectable to the valve assembly 300 and to the conduit connector assembly 500 discussed below.

Figure 3A:
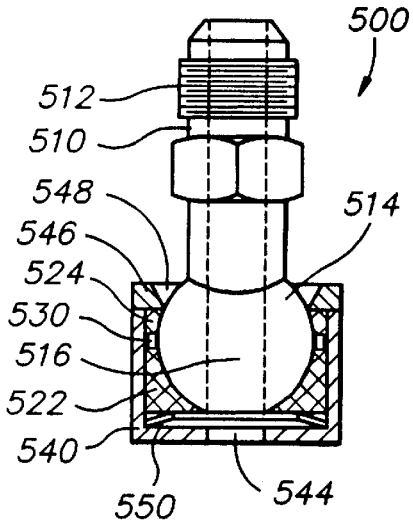
FIG. 3*a* is a partial sectional view of a swivel connector assembly according to an exemplary embodiment of the invention.

In the exemplary embodiment, the connector assembly 500 is a swivel connector assembly that permits the housing 100 to rotate and pivot relative to the supply conduit S. FIG. 3*a* shows a swivel connector assembly 500 with a conduit connector 510 having a threaded portion 512 for coupling with the supply conduit S, and a ball portion 514 disposed in a ball socket assembly. The conduit connector 510 includes a fluid passage port 516, which allows fluid flow from the supply conduit S to the conduit assembly 800. The ball socket assembly includes a ball seat portion 522 and a ball retention portion 524 separated by an annular sealing member 530 disposed about a circumferential portion of the ball portion 514 to form a seal. In one embodiment, the sealing member is an elastomeric O-ring or quad-ring, and in an alternative embodiment the sealing member 530 is a spring loaded cup seal 530 like an Omniseal™ 103A type seal with a Standard Lip and Heel available from Furon Company, Los Alamitos, Calif. The ball socket is housed in a socket housing 540, which forms an integral part of the conduit assembly 800 in the exemplary embodiment, but may alternatively be a separate component coupled to the conduit assembly 800. The socket housing 540 includes a cavity with a fluid port 544 for receiving the ball socket assembly and a retention plate 546 with a port hole 548 for retaining the socket assembly in the socket housing 540. A spring member 550 like a wave spring, or a disk spring, or a spiral spring may be disposed in the cavity of the socket housing 540 to urge or preload the socket assembly toward the retention plate 546. In the exemplary embodiment, the ball seat portion 522 and the ball retention portion 524 are made from a bearing bronze material or other material that provides good heat transfer between the supply conduit S and the heated conduit assembly 800. In alternative embodiments, the ball seat portion 522 and the ball retention portion 524 are made from Torlon™ or some other synthetic material. The housing 540 and retention plate 546 may similarly be formed of a heat conducting material for heated applications. In one embodiment, the swivel connector permits 360 degrees rotation and between approximately 30 and 35 degrees of pivoting motion, and in an alternative embodiment between approximately 35 and 40 degrees of pivoting motion. The port hole 548 of the retention plate 546 has a bevelled surface for increased pivoting motion, and in another embodiment the port hole 548 has oblong end portions 549 to permit an increased range of pivoting motion along one axis, which is particularly useful for forward and backward pivoting of the dispenser. In an alternative embodiment, the range of rotational movement may be limited to some degree of rotation in both directions by stop members, not shown in the drawing, to prevent excessive twisting of the supply cables. In the exemplary embodiment, the supply conduit S includes a threaded coupling member T, but alternative embodiments may include other quick release engagement and retention means. A flexible boot B may alternatively be extended from the supply conduit S and skirted over the housing 100 to protect the connector 500 from fluid spray and particulate matter. The swivel connector assembly 500 thus provides an increased range of motion, and its location away from the nozzle 200 and proximate the intersection of the handle portions to provide a more balanced hand held dispenser, which reduces interference from the conduits and cables and reduces operator fatigue.

Figure 4:
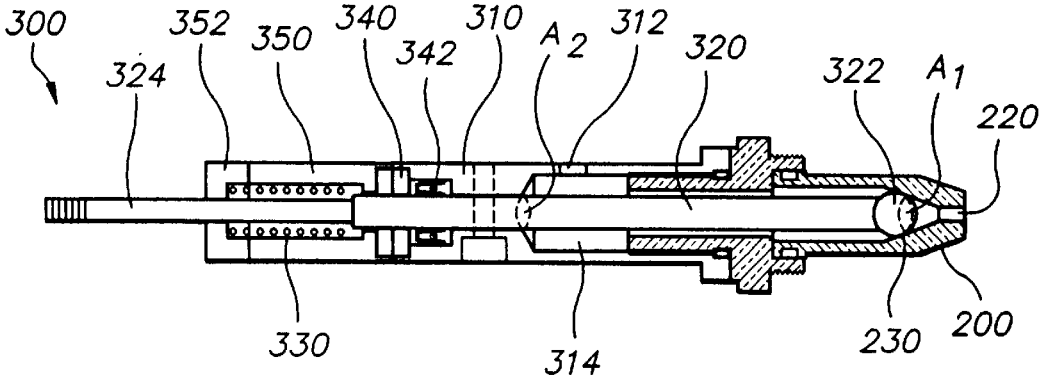
FIG. 4 is a partial sectional view of a balanced valve assembly and a nozzle according to an exemplary embodiment of the invention.

FIG. 4 is a partial sectional view of a valve assembly 300 coupled with a nozzle 200 having an orifice 220 according to an exemplary embodiment of the invention wherein the valve assembly 300 interconnects the conduit assembly 800 and the nozzle 200 as shown in FIG. 1. The valve assembly 300 includes a valve body 310 with a fluid intake port 312 coupled to an interior fluid flow cavity 314, which communicates with the nozzle orifice 220. A valve stem 320 is slidably disposed through the fluid flow cavity 314 of the valve body 310, and includes a seating member 322 biased against a valve seat 230 in the nozzle 200 by a spring member 330 to prevent fluid from being dispensed from the nozzle 200. The valve stem 320 is aligned in the valve body 310 by a bushing 340. An annular seal 342 provides a seal between the valve stem 320 and the valve body 310. The seal 342 may be an elastomeric O-ring, or quad-ring, or a cup seal of the type discussed above that provides a seal about a circumferential portion of the valve stem 320. The spring member 330 is disposed in a spring retainer 350 coupled to the valve body 310 and enclosed with a cover 352. The valve assembly 300 is coupled to the conduit assembly 800 by bolts or other fastening means permitting ready assembly and disassembly of the components. FIG. 1*a* shows an end portion 324 of the stem 320 coupled to a valve actuator 360 with a transverse member 362, which is engagable by the valve actuator engagement surfaces 416 and 436 of the first and second triggers, respectively. In operation, actuation of either the trigger 410 or 430 slides the valve stem 320 against the bias of spring member 330 to unseat the seating member 322 from the valve seat 230 within the nozzle to permit the dispensing of fluid, supplied by the fluid supply S, through the nozzle orifice 220.

The spring member 330 has a spring force sufficient to close or reseat the seating member 322 on the valve seat 230 upon release of the trigger. The spring force required to reseat the seating member 322 is dependant on a number of factors particular to the application including fluid viscosity, fluid flow rate and nozzle orifice. In the exemplary melted adhesive dispenser embodiment, the spring force is between 10 and 13 pounds. The trigger actuation force, or trigger pull, required to overcome the spring force is reduced to between approximately 2 and 4 pounds by the leveraging action of the trigger by optimizing the location of the trigger pivot axis relative to the transverse member 362, but the dimensions and configuration of the interior of the housing 100 limit generally the extent to which the trigger pull may be reduced by leveraging action.

A reduction in the spring bias required to close the nozzle results in a proportionate reduction in the leveraged trigger pull required to overcome the spring force and unseat the seating member 322. In the exemplary embodiment, the spring force of the spring member 330 is minimized by providing a substantially balanced valve assembly 300. The valve assembly 300 is balanced when the cross-sectional area $A_1$ of the valve seating member 322 at the valve seat 230 is equal to the cross-sectional area $A_2$ of the valve stem 320 at the seal 342. Any valve imbalance resulting from disparity in the respective cross-sectional areas $A_1$ and $A_2$ of the seating member 322 and valve stem 320, respectively, must ultimately be offset by additional pull on the trigger. The additional pull on the trigger is required either to offset directly the imbalance resulting from a pressure induced force tending to seat the valve stem seating member 322 on the valve seat 230, or to offset imbalance resulting from an increased spring force required to seat the valve seating member 322 on the valve seat 230 against a pressure induced force tending to unseat the valve stem seating member 322 from the valve seat 230. The required spring force of spring member 330 therefore is reduced in proportion to the extent that the valve assembly 300 is balanced, and the required spring force is minimized when the valve assembly 300 is balanced.

In one embodiment, the valve actuation assembly 360 includes a body 361 coupled to the valve stem 320 and a switch actuator stem 364 coupled to the transverse member 362 by threads or other fastening means. The transverse member 362 is movable in an oblong slot 366 in the body member 361, and the switch actuator stem is movable in an axial bore in the body member 361. A spring member, not shown, biases the transverse member 362 and switch actuator stem 364 assembly along the axial dimension of the body member 361 toward the valve assembly 300. In operation, the trigger 410 or 430 is engagable initially with the transverse member 362 to move the transverse member 362 and switch actuator stem 364 assembly, against the bias of the spring member, relative to the body member 361 to actuate the electrical switch 730 without movement of the body member 361. Upon actuation of the electrical switch 730 and continued actuation of the trigger 410 or 430, the transverse member 362 engages an end portion of the slot 366 and moves the body member 361 coupled to the valve stem 320 to unseat the valve seating member 322 from the valve seat 230 to open the nozzle. The switch actuator 364, therefore, is movable to actuate an electrical switch 730 before unseating the valve seating member 322 from the valve seat 230. In one embodiment, the switch 730 actuates a fluid supply pump, not shown, for supplying fluid through fluid supply conduit S and an air supply valve for supplying auxiliary air, both of which must be actuated before opening the nozzle by unseating the valve seating member 322 from the valve seating 230. Upon release of the trigger, the valve seating member 322 is first seated on the valve seat 230 to close the nozzle 200 before the switch actuator 364 de-actuates the electrical switch 730, which deactuates the fluid supply pump and air supply valve.

A thermal insulating material may be disposed in the cavities of the handle portion H and body portion B to improve thermal insulation of any heated components mounted within the housing 100. In one embodiment, an insulating coating material 850 is applied to surfaces of the heated body member 800, the swivel connector assembly 500, and the valve actuation assembly 300. Additionally, insulating coatings 850 may be applied to the surfaces of the cavities of the housing 100 to further increase insulation. FIG. 1*a* shows the thermal insulating coating 850 on only portions of the heated components and housing to simplify the drawing. Insulating coating materials usable for this purpose include ceramic tapes and insulating polymer and ceramic compositions like Miracle/Therm™, which is available from St. Louis Factory Supply, Inc., St. Louis, Mo. A 15 mil coating of Miracle/Therm liquid insulation applied to the heated components and cavity surfaces provides an R-20 equivalent insulation. Insulating materials may be additionally and alternatively filled into voids of the housing cavities between the heated components and the housing. Fill type insulating materials usable for this purpose include non-woven insulating materials like Nomex 450™, and Craneglas 230™ available from Crane and Co., Inc. Dalton, Mass., and insulating foams like Solimide™ available from Imi-Tech, Elk Grove Village, Ill. In yet another embodiment, a thermal insulating material is disposed on the exterior hand gripping portions of the housing as an additional or alternative form of insulation from any heated components within the housing. The insulating material may be formed integrally with the gripping portion of the housing or may be a removable thermal insulating cover, which permits ready cleaning and servicing of the cover and dispenser. The thermal insulating material on the exterior of the hand gripping portions may also provide improved gripping performance and shock resistance.

While the foregoing written description of the invention enables anyone skilled in the art to make and use what is at present considered to be the best mode of the invention, it will be appreciated and understood by those skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. A hand held apparatus for dispensing fluid from a fluid supply, the apparatus comprising:

a housing having a first body portion and a second body portion;

a nozzle for dispensing the fluid, the nozzle coupled to the fluid supply;

a valve assembly disposed in the housing and interconnecting the nozzle and the fluid supply wherein the valve assembly is actuatable to control fluid dispensed by the nozzle;

a first trigger for actuating the valve assembly, the first trigger disposed on one side of the housing;

a second trigger for actuating the valve assembly, the second trigger disposed on the same side of the housing as the first trigger, wherein the first trigger is usable to actuate the valve assembly when the first body portion of the housing is used as a hand grip, and the second trigger is usable to actuate the valve when the second body portion of the housing is used as a hand grip.

2. The apparatus of claim 1 wherein the first trigger is nested within the second trigger, the first trigger is pivotably coupled relative to the housing and the second trigger is pivotably coupled relative to the housing wherein the first trigger is actuatable independent of the second trigger.

3. The apparatus of claim 1 further comprising a connector assembly for coupling a fluid supply conduit to the nozzle, the connector assembly having a conduit connector with a ball portion disposed in a ball socket, the ball socket having a sealing member disposed about a circumference of the ball portion, the sealing member disposed between a ball seat and a ball retainer wherein the conduit connector is rotatable and pivotable relative to the ball socket.

4. The apparatus of claim 1 wherein the first body portion of the housing is a handle, and the second body portion of the housing is a barrel with a fluid dispensing end extending from the handle, the housing further comprising a trigger guard interconnecting the barrel and the handle wherein the trigger guard encloses the first trigger and the second trigger.

5. The apparatus of claim 4 wherein the trigger guard is a hollow member with a port hole proximate the nozzle for plumbing an air supply hose from the handle to the nozzle.

6. The apparatus of claim 1 wherein the valve assembly includes a valve stem with a valve seating member biased toward a valve seat by a spring member to close the nozzle.

7. The apparatus of claim 6 wherein a cross-sectional area of the valve stem is substantially equal to a cross-sectional area of the valve seating member at the valve seat to provide a substantially balanced valve assembly.

8. The apparatus of claim 6 wherein the fluid is a melted adhesive, the apparatus further comprising:

a trigger guard interconnecting the first body portion and the second body portion wherein the trigger guard encloses the first trigger and the second trigger, a heated conduit assembly coupled to the fluid supply, the valve assembly interconnecting the heated conduit assembly to the nozzle;

a connector assembly for coupling a fluid supply conduit to the heated conduit assembly, the connector assembly having a conduit connector with a ball portion disposed in a ball socket, the ball socket having a sealing member disposed about a circumference of the ball portion, the sealing member disposed between a ball seat and a ball retainer wherein the conduit connector is rotatable and pivotable relative to the ball socket.

9. The apparatus of claim 8 comprising an assembly of modules wherein the first body portion and the second body portion form a housing module, the first trigger and second trigger form a trigger module, the heated conduit assembly forms a heated conduit module, the valve assembly forms a valve module, and the connector assembly forms a connector module.

10. The apparatus of claim 8 further comprising an insulating material disposed within the housing for insulating any heated components.

11. A hand held apparatus for dispensing fluid from a fluid supply, the apparatus comprising:

a housing having a first body portion and a second body portion;

a nozzle for dispensing the fluid, the nozzle coupled to the fluid supply;

a valve assembly disposed in the housing and interconnecting the nozzle and the fluid supply, the valve assembly having a valve stem with a valve seating member biased toward a valve seat by a spring member to close the nozzle, a cross-sectional area of the valve stem is substantially equal to a cross-sectional area of the valve seating member at the valve seat to provide a substantially balanced valve assembly, wherein a spring force of the spring member required to seat the valve seating member on the valve seat is reduced in proportion to the extent that the valve assembly is balanced; and a trigger assembly for actuating the valve assembly by unseating the valve seating member from the valve seat against the bias of the spring member to open the nozzle and permit dispensing of fluid from the nozzle.

12. The apparatus of claim 11 wherein the cross-sectional area of the valve stem is equal to the cross-sectional area of the valve seating member at the valve seat to provide a balanced valve assembly.

13. The apparatus of claim 11 further comprising a connector assembly for coupling a fluid supply conduit to the nozzle, the connector assembly having a conduit connector with a ball portion disposed in a ball socket, the ball socket having a sealing member disposed about a circumference of the ball portion, the sealing member disposed between a ball seat and a ball retainer wherein the conduit connector is rotatable and pivotable relative to the ball socket.

14. The apparatus of claim 11 wherein the trigger assembly includes a first trigger for actuating the valve assembly, the first trigger disposed on one side of the housing, a second trigger for actuating the valve assembly, the second trigger disposed on the same side of the housing as the first trigger, wherein the first trigger is usable to actuate the valve assembly when the first body portion of the housing is used as a hand grip, and the second trigger is usable to actuate the valve when the second body portion of the housing is used as a hand grip.

15. The apparatus of claim 14 wherein the first trigger is nested within the second trigger, the first trigger is pivotably coupled relative to the housing and the second trigger is pivotably coupled relative to the housing wherein the first trigger is actuatable independent of the second trigger.

16. The apparatus of claim 14 wherein the first body portion of the housing is a handle, and the second body portion of the housing is a barrel with a fluid dispensing end extending from the handle, the housing further comprising a trigger guard interconnecting the barrel and the handle wherein the trigger guard encloses the first trigger and the second trigger.

17. The apparatus of claim 16 wherein the trigger guard is a hollow member with a port hole proximate the nozzle for plumbing an air supply hose from the handle to the nozzle.

18. The apparatus of claim 14 wherein the fluid is a melted adhesive, the apparatus further comprising:

a trigger guard interconnecting the first body portion and the second body portion wherein the trigger guard encloses the first trigger and the second trigger, a heated conduit assembly coupled to the fluid supply, the valve assembly interconnecting the heated conduit assembly to the nozzle;

a connector assembly for coupling a fluid supply conduit to the heated conduit assembly, the connector assembly having a conduit connector with a ball portion disposed in a ball socket, the ball socket having a sealing member disposed about a circumference of the ball portion, the sealing member disposed between a ball seat and a ball retainer wherein the conduit connector is rotatable and pivotable relative to the ball socket.

19. The apparatus of claim 18 comprising an assembly of modules wherein the first body portion and the second body portion form a housing module, the first trigger and second trigger form a trigger module, the heated conduit assembly forms a heated conduit module, the valve assembly forms a valve module, and the connector assembly forms a connector module.

20. The apparatus of claim 18 further comprising an insulating material disposed within the housing for insulating any heated components.

* * * * *